US006175999B1

(12) United States Patent
Sloan et al.

(10) Patent No.: US 6,175,999 B1
(45) Date of Patent: Jan. 23, 2001

(54) UNIVERSAL FIXTURE FOR PRE-ASSEMBLY OF COMPUTER COMPONENTS

(75) Inventors: Robert Sloan, Round Rock; Mark Manley, Leander, both of TX (US)

(73) Assignee: Dell USA, L.P., Round Rock, TX (US)

( * ) Notice: Under 35 U.S.C. 154(b), the term of this patent shall be extended for 0 days.

(21) Appl. No.: 09/228,963

(22) Filed: Jan. 12, 1999

(51) Int. Cl.[7] ..... B25B 27/14

(52) U.S. Cl. ..... 29/281.4; 29/281.5; 269/79; 269/40; 269/903; 269/285; 269/286

(58) Field of Search ..... 269/79, 285, 286, 269/274, 71, 40, 37, 903; 29/281.1, 281.4, 281.5

(56) References Cited

U.S. PATENT DOCUMENTS 2,365,436 * 12/1944 Saucier ..... 269/79
4,261,555 * 4/1981 Adams ..... 269/274
5,240,234 * 8/1993 Lee ..... 269/274
5,259,602 * 11/1993 Rogos ..... 269/79
5,507,650 4/1996 Larabell .
5,513,099 4/1996 Schein .
5,668,696 9/1997 Schmitt .
5,820,120 * 10/1998 Anderson ..... 269/285
5,954,205 * 9/1999 Smith ..... 209/2

* cited by examiner

*Primary Examiner*—Robert C. Watson
(74) *Attorney, Agent, or Firm*—Haynes and Boone, L.L.P.

(57) ABSTRACT

A universal fixture for a pre-assembly of computer components includes a base and a support plate adjustably mounted on the base for movement to various inclined positions. At least one support arm interconnects the base and the support plate for securing the support plate in an inclined position. A fixture is rotatably mounted on the support plate and includes various positioning stops and an adjustable slide for properly positioning various computer components for attaching chassis mounting devices to the components. The adjustment of the support plate and rotation of the fixture provide ergonomic advantages to the assembler performing the pre-assembly operations.

23 Claims, 6 Drawing Sheets

UNIVERSAL FIXTURE FOR PRE-ASSEMBLY OF COMPUTER COMPONENTS

BACKGROUND

The disclosures herein relate generally to computer systems and more particularly to a single work fixture capable of locating various computer components in a common plane so that pre-assembly attachments may be added to the components.

During the manufacturing process where various computer components are being installed in a computer chassis, some pre-assembly is required. Various components are purchased from suppliers and combined to produce a specified computer system. These components include ZIP drives, floppy drives, hard drives, and CD Rom devices. Pre-assembly may require, for example, so that side rails be added to permit the components to be slide mounted in the computer chassis for easy installation and removal. It is of utmost importance that the side rails be attached with the correct alignment so that the component can be mounted in the correct orientation within the chassis. If correct alignment is not achieved, the component may not be positioned in the chassis at the correct height or setback to permit chassis bezels and other cover plates to be flush mounted with an exposed face of the components.

An example of mounting a computer peripheral chassis in a server is disclosed in U.S. Pat. No. 5,686,696 which illustrates a structure for removably mounting a chassis within a bay in a frame. The structure includes a stationary mount coupled to an inner wall of the bay. The stationary mount has a guide rail and a cam slot associated therewith, a chassis carrier having a cradle associated therewith for receiving a chassis and a carrier guide rail on an outer surface thereof, and a mounting handle rotatably coupled to the chassis carrier to rotate between an insertion orientation and a mounted orientation. The mounting handle has a cam follower associated therewith. The mount and carrier guide rails are engageable to guide the chassis carrier along a substantially linear path through the bay. The cam follower is engageable with the cam slot only when the mounting handle is substantially in the insertion orientation. The cam follower traverses the cam slot to urge the chassis carrier along the substantially linear path toward a mounted position as the mounting handle is rotated toward the mounted orientation.

U.S. Pat. No. 5,507,650 discloses an array of daisy chained slides for receiving carrier mounted electrical devices for connection with electrical equipment. This daisy chained array includes a bus cable having two ends and a data connecter attached at each end. The bus cable is adapted for connection with the electrical equipment. The array also includes a plurality of slides, each slide having a slide data connector. Each data connector is attached to the cable between the ends in a daisy chained fashion. Each of the slides is adapted to receive a carrier compatible for sliding and mating connection with the slide. The carrier includes an electrical device, such as a hard or floppy disk. The carrier has a carrier data connector for mating with the slide data connector. The carrier data connector is attached to one end of a stub cable. The other end of the stub cable is attached to a device data connector for connection with the electrical device. Carrier mounted hard disks are then conveniently removed and installed while the system continues to operate. The carrier also includes a switch for assigning an identification number to the electrical device.

Therefore, what is needed is a single fixture formed of anti-static material and capable of locating ZIP drives, floppy drives, hard drives, CD ROM devices and other devices, in the correct orientation so that side rails and brackets can be attached with the proper alignment for correctly positioning these devices in the computer chassis.

SUMMARY

One embodiment, accordingly, provides a universal fixture for positioning various computer components so that pre-assembly preparation of the components are quickly and easily accomplished. To this end, a workpiece holder includes a base, a support plate pivotally mounted on the base, and a fixture rotatably mounted on the support plate.

A principal advantage of this embodiment is that the workpiece component is located in the fixture and automatically aligned for accurate location and attachment of the mounting side rails with the proper height and setback so that the component is installed in correct orientation with the computer chassis, bezels and cover plates. In addition, inclined height adjustment of the support plate, and rotation of the fixture on the support plate, provide an ergonomic advantage to the assembler performing the pre-assembly operations.

BRIEF DESCRIPTION OF THE DRAWINGS FIGURES

DETAILED DESCRIPTION

Figure 1:
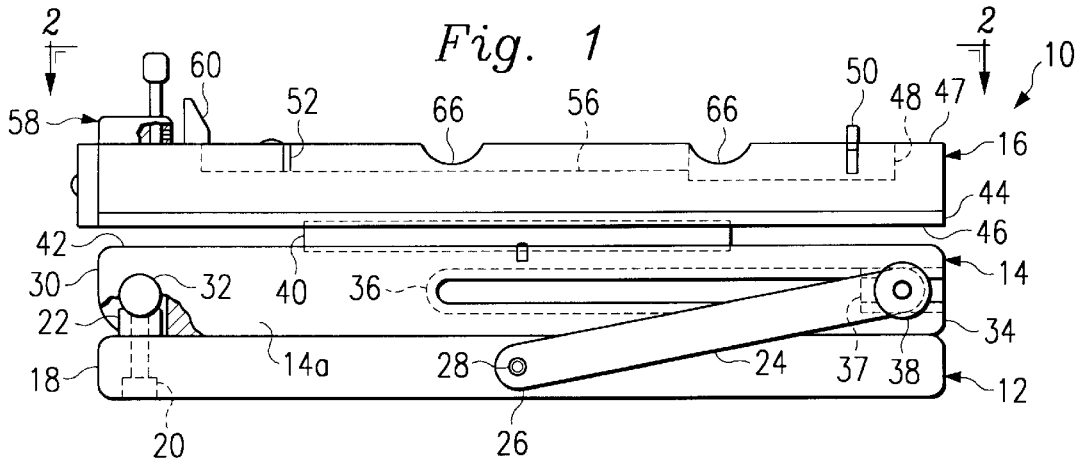
FIG. 1 is a side view illustrating an embodiment of a workpiece holder.

A workpiece holder is generally designated 10 in FIG. 1 and includes a base 12, a support plate 14 pivotally mounted for inclined adjustment on base 12, and a fixture plate 16 rotatably mounted on the support plate 14.

Base 12 is formed of a machinable molded plastic material which is preferably a commercially available ultra-high molecular weight (UHMW) anti-static material. One end 18 of base 12 includes a connector 20 for retaining a pivot mount 22 for pivotal connection to support plate 14. A support arm 24 includes a first end 26 pivotally connected to base 12 at a pivot pin 28.

Support plate 14 is formed of a machinable molded plastic material which may also be the UHMW anti-static material mentioned above. One end 30 of support plate 14, adjacent end 18 of base 12, includes a rotatable pivot member 32 attached thereto and supported by pivot mount 22 for pivotally interconnecting support plate 14 and base 12. A second end 34 of support plate 14 includes an elongated groove 36 formed in a peripheral edge 14*a* thereof slidably receiving a slide block 37 attached to a second end 38 of support arm 24. A thrust washer 40 is bearing mounted in the surface 42 of support plate 14 for connection with fixture plate 16.

Fixture plate 16 is also formed of a machinable molded plastic material which is preferably the UHMW anti-static material mentioned above. To avoid warping of fixture plate 16, an anti-warp plate 44 is attached to reinforce and stiffen fixture plate 16, and is preferably formed of a suitable metallic material. Fixture plate 16 includes a surface 46 connected to washer 40 for rotatably mounting fixture plate 16 on support plate 14 for rotation in clockwise direction C1 and counter-clockwise direction C2. A recess 48 is formed in a surface 47 of fixture plate 16, FIGS. 1 and 2, for receiving a workpiece therein, to be discussed below.

A plurality of stops are mounted in fixture plate 16. A pair of stops 50 are manually, reciprocally adjustable in recess 48 from a retracted position P1 to an extended position P2. As a result, positioning of a workpiece can be altered depending on the position of the stops 50. Another pair of stops 52 are resiliently mounted in fixture plate 16 so as to yield toward an angled surface 53, in response to positioning of a workpiece in recess 48. In addition to stops 50 and 52, other means are provided in recess 48 for accommodating various size workpieces.

An adjustable slide member 58 is mounted for sliding engagement in a groove 54 formed in a support surface 56 of recess 48. Slide member 58 includes an extension member 60, resiliently mounted to extend from adjustable slide member 58 by means of a compression spring 62 receiving a shaft 64, for providing flexibility to the engagement of slide member 58 and a workpiece mounted in recess 48. A plurality of tool access grooves 66 are formed in surface 47 of fixture plate 16 to provide tool access to a workpiece mounted in recess 48. In addition, at least one resilient pad 70 is mounted in support surface 56 of recess 48. Pad 70 is preferably a static control mat such as part number 8200 manufactured by the 3M Company of Minneapolis, Minn. Pad 70 may be in the form of a large single pad or a plurality of strips 70*a*, 70*b*, 70*c* of the pad material.

Figure 2:
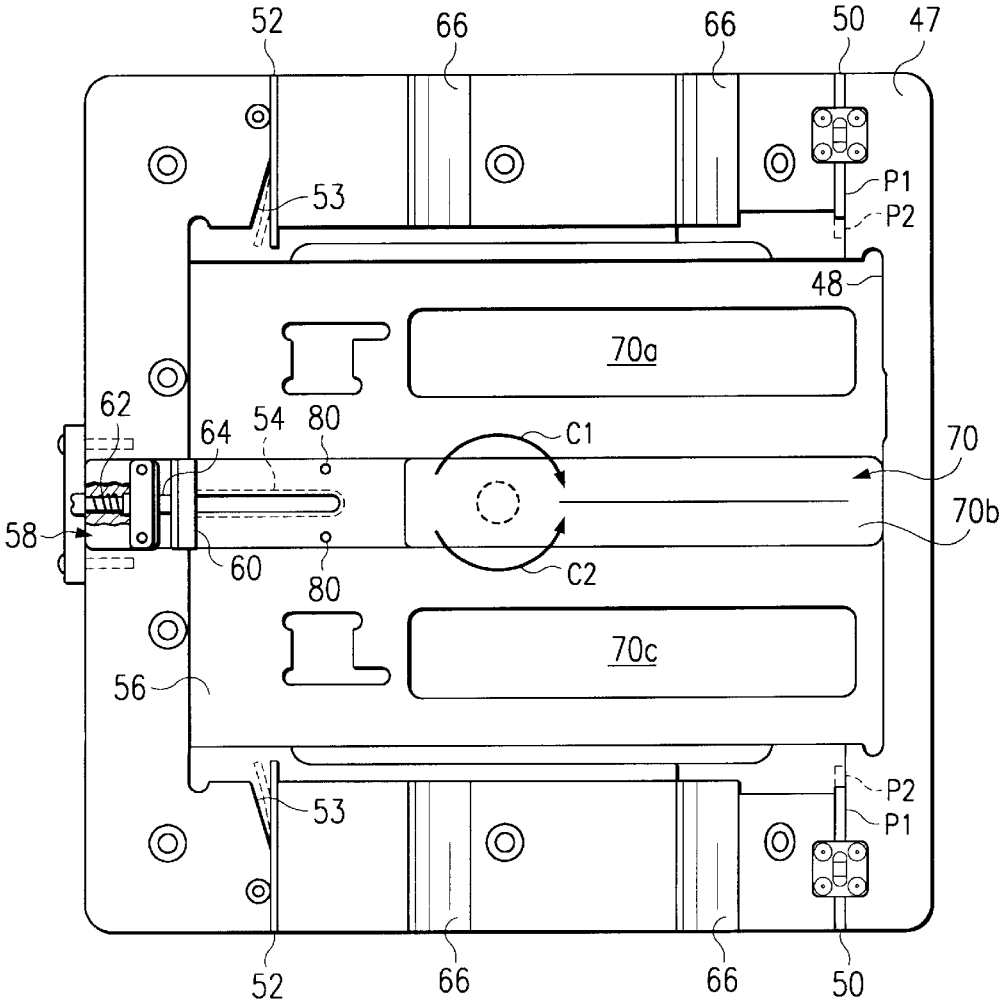
FIG. 2 is a top view illustrating an embodiment of a fixture portion of the workpiece holder as viewed along the line 2—2 of FIG. 1.
Figure 3:
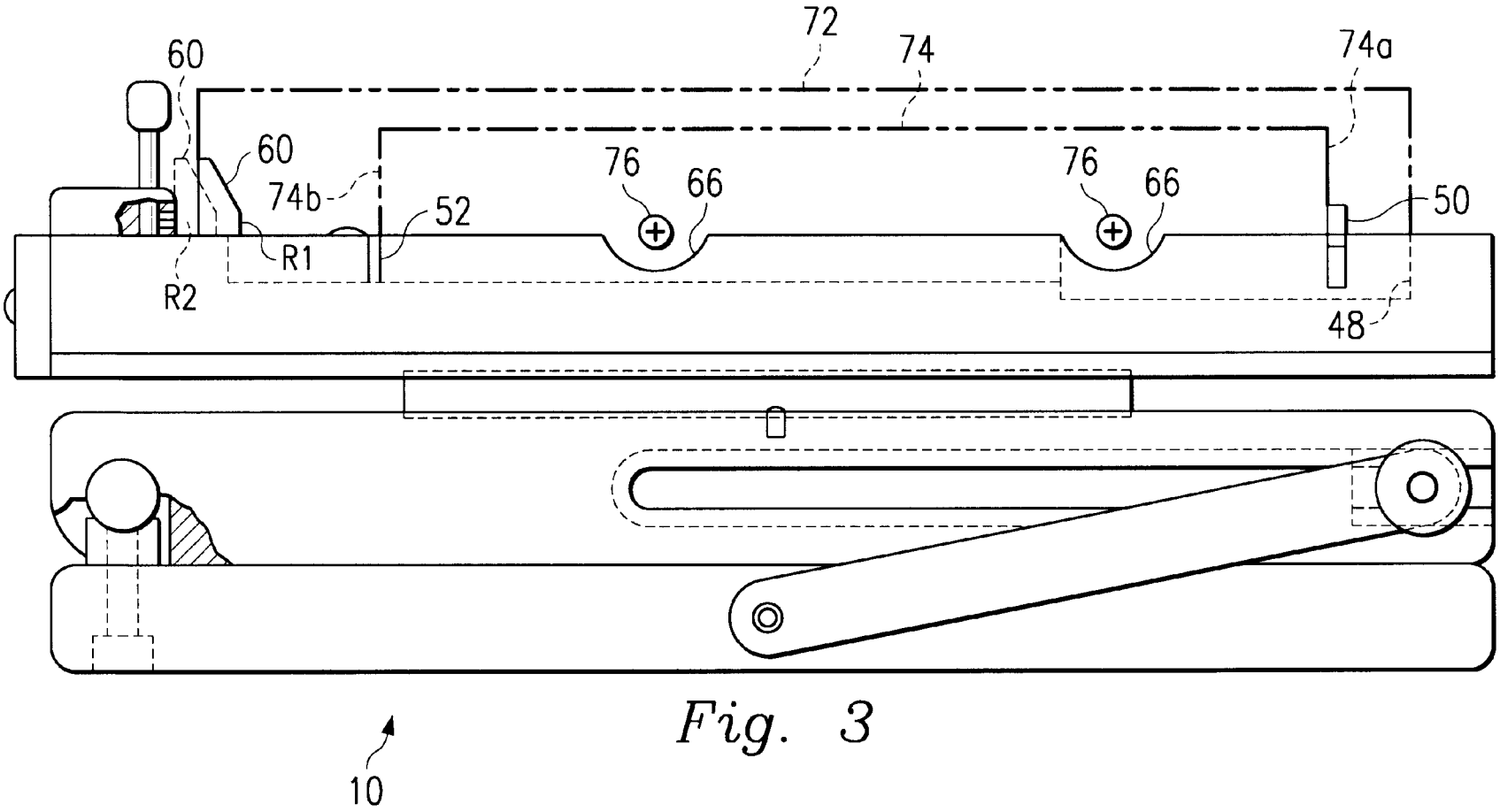
FIG. 3 is an enlarged side view illustrating an embodiment of the workpiece holder.

In FIG. 3, movement of resiliently biased extension member 60 of workpiece holder 10 is illustrated. A workpiece such as a peripheral unit 72, for a computer, is illustrated in phantom outline. Unit 72 urges extension member 60 from an at rest position R1 to a displaced position R2 upon insertion of workpiece 72 into recess 48. Thus, the extension member 60 can allow for ease of insertion and removal of a workpiece in recess 48. Also, the resiliently biased extension member 60 can account for minor tolerance and dimensional differences in various workpieces. In addition, a side rail 74 to be attached to unit 72 may have a first end 74*a* accurately positioned relative to unit 72 due to the use of the stops 50, which may be manually extended to position P2, FIG. 2, if required. Other side rails having other mounting requirements, may be accurately positioned without the use of the stops 50. Additionally, a second end 74*b*, FIG. 3, of side rails 74 may, if necessary, urge resilient stops 52 in the direction of their respectively angled surfaces 53, see also FIG. 2.

Figure 4:
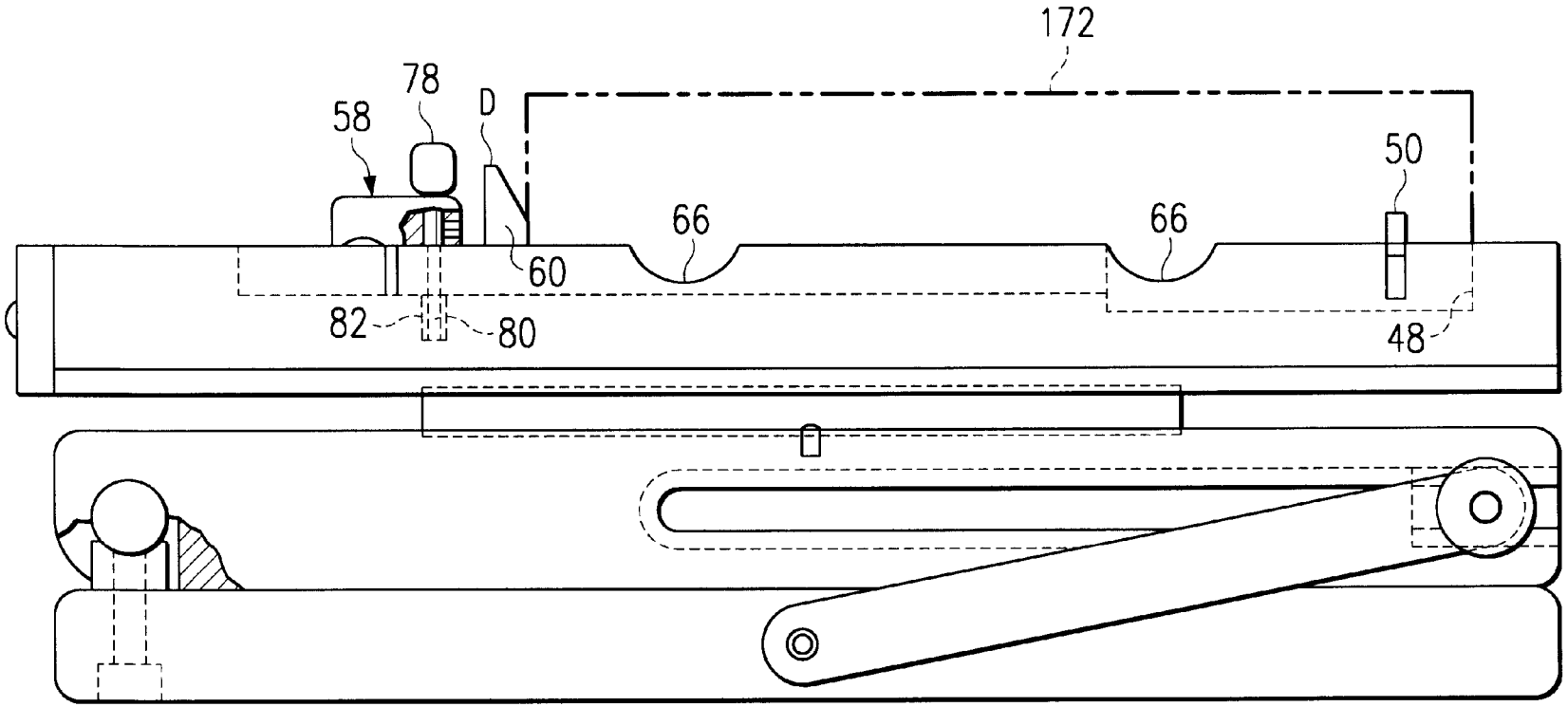
FIG. 4 is another enlarged side view illustrating an embodiment of the workpiece holder.

In FIG. 4, movement of slide member 58 for accommodating various sized workpieces, such as a workpiece 172, is accomplished by moving slide member 58 in groove 54, FIG. 2, to a displaced position D, FIG. 4. A lock member 78 may be moved to insert a lock pin or pins 80 into a mating lock recess or recesses 82, see also FIG. 2. This repositions slide member 58 to position D, FIG. 4, and thus accommodates workpiece 172. Also, because extension member 60 moves with slide member 58, extension member 60 is positioned relative to slide member 58, regardless of the size of a workpiece mounted in recess 48. As discussed above, stops 50, and tool access grooves 66 are available for use, in connection with mounting side rails, brackets, or the like, not shown in FIG. 4, on workpiece 172 as discussed above.

Figure 5:
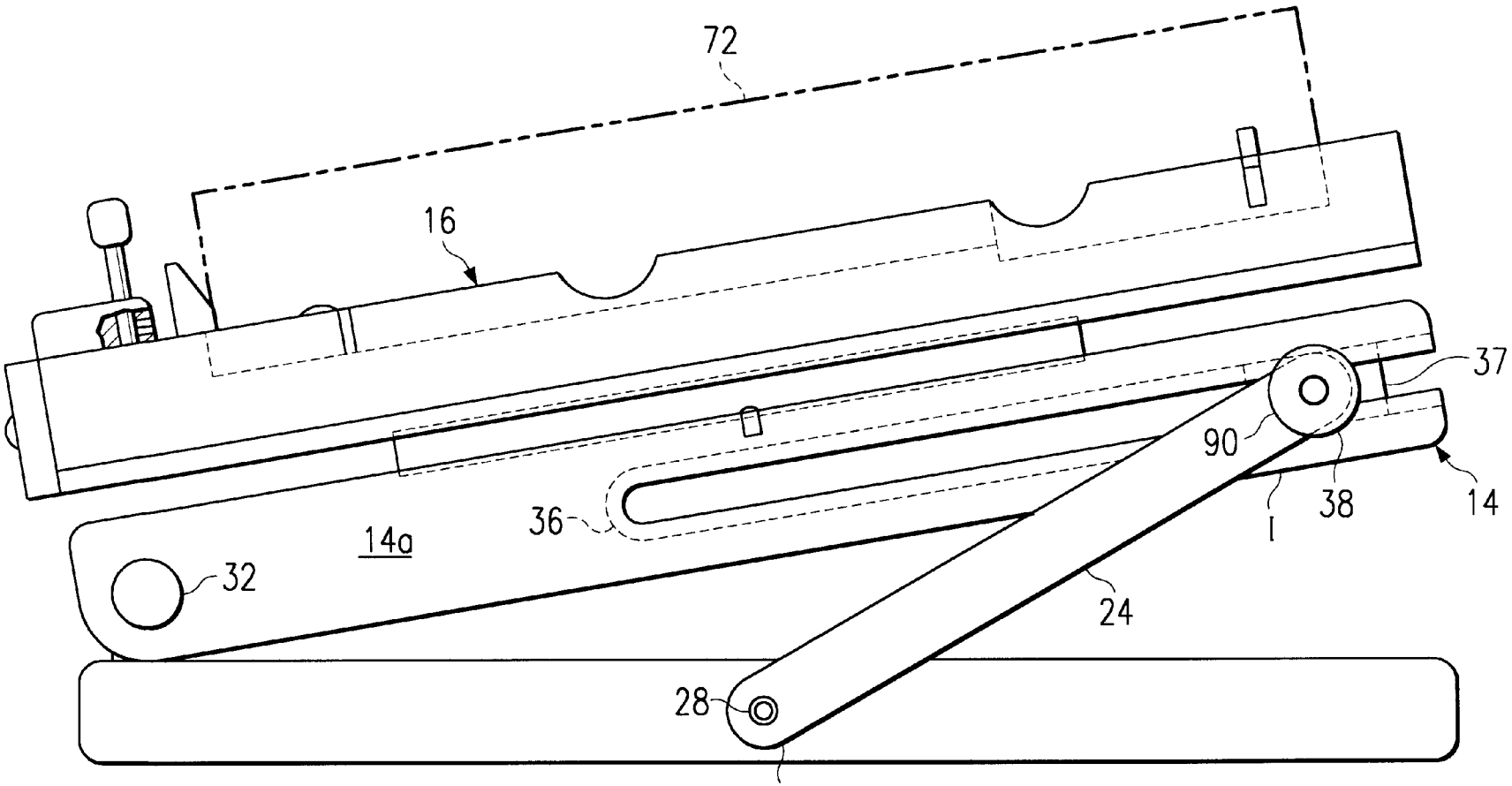
FIG. 5 is a further enlarged side view illustrating an embodiment of the workpiece holder.

In FIG. 5, support plate 14 is pivoted to an inclined position I by pivoting support plate 14 about pivot member 32. This is accomplished by movement of a suitable tensioning device 90, threadably connected to second end 38 of support arm 24, for releasing and securing the position of slide block 37 which moves in groove 36 as first end 26 of support arm 24 simultaneously pivots about pivot pin 28. Tensioning device 90 may, for example, operate to threadably engage slide block 37 and support arm 24 so that tensioning device 90 may be rotated in one direction for drawing block 37 and arm 24 into engagement with edge 14*a*, thereby securing block 37 in groove 36, and rotated in an opposite direction for releasing block 37 and arm 24 from engagement with edge 14*a*, thereby releasing block 37 to move in groove 36. The inclined fixture plate 16 may advantageously secure workpiece 72 in an inclined position for permitting work to be accomplished in an ergonomically suitable manner. Also, in the inclined position I as well as in a non-inclined position, see FIG. 4, fixture plate 16 may be rotated relative to support plate 14 in the clockwise direction C1 and the counter-clockwise direction C2, see FIG. 2.

Figure 6:
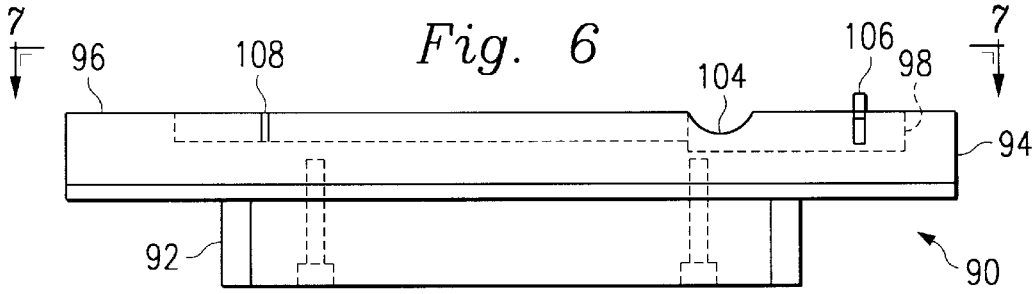
FIG. 6 is a side view illustrating an embodiment of first adapter plate for mounting on the workpiece holder.
Figure 7:
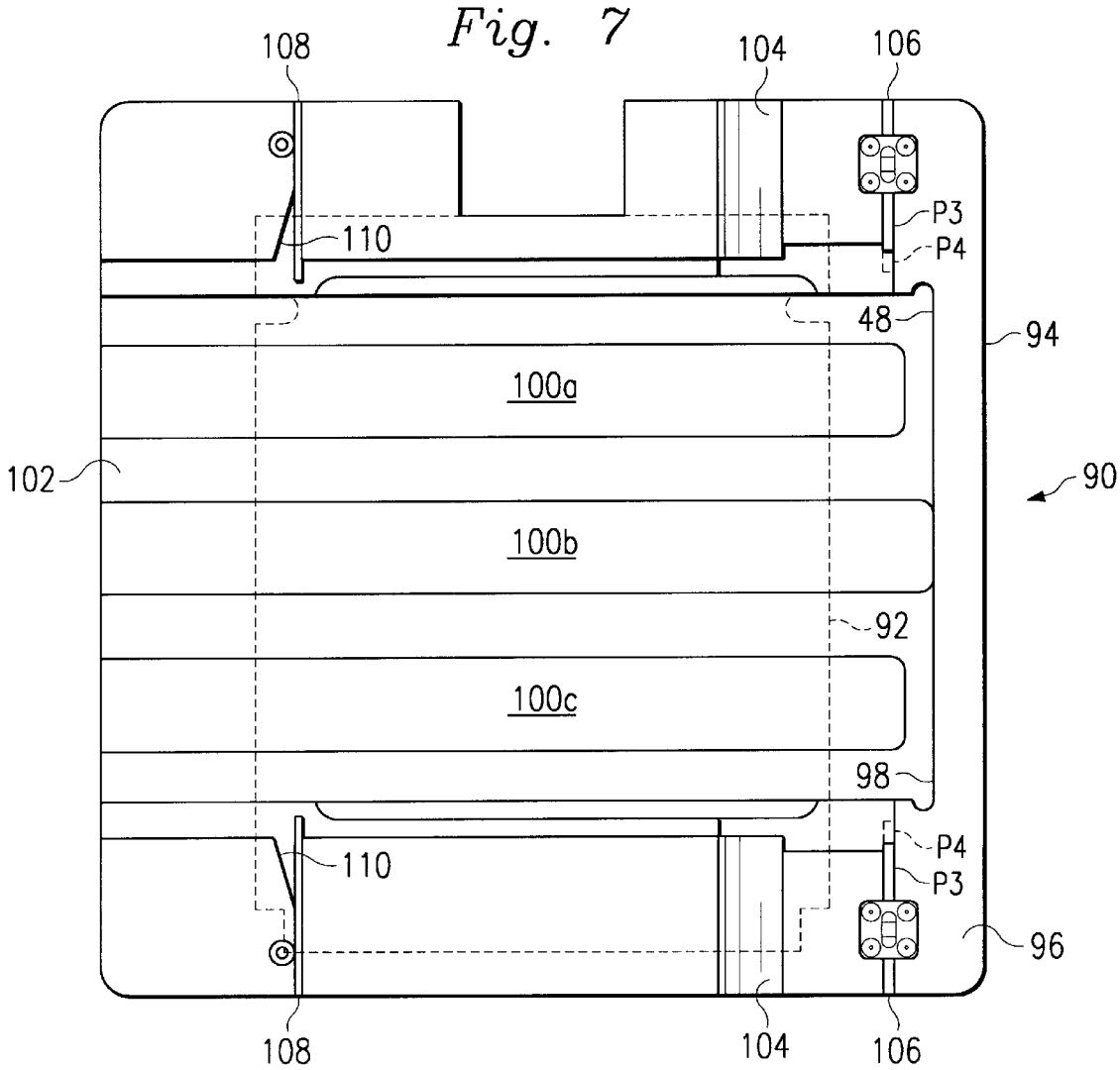
FIG. 7 is a top view illustrating an embodiment of the first adapter plate as viewed along the line 7—7 of FIG. 6.

An adapter plate 90, FIGS. 6 and 7, may be used in connection with fixture plate 16. Adapter plate 90 includes a base 92 and a fixture 94 attached thereto. Plate 90 is preferably formed of a machinable molded plastic material of the UHMW type mentioned above. Base 92 inserts into recess 48 of fixture plate 16, FIGS. 1 and 2, so that adapter plate 90 is supported on workpiece holder 10 and can therefore be inclined and rotated with fixture plate 16 as discussed above.

Plate 90, FIGS. 6 and 7, includes a surface 96 having a recess 98 formed therein, similar to recess 48 discussed above. Also, plate 90 includes a plurality of resilient pad strips 100*a*, 100*b* and 100*c*, mounted on a support surface 102 of recess 98. The strips 100*a*, 100*b* and 100*c* are preferably formed of the anti-static material discussed above regarding strips 70*a*, 70*b* and 70*c*. A plurality of tool access grooves 104 are formed in surface 96 of plate 90 to provide tool access to a workpiece which may be mounted in recess 98. Also a plurality of stops such as a first pair of stops 106 and a second pair of stops 108 are mounted in plate 90. Stops 106 are manually, reciprocally adjustable in recess 98 from a retracted position P3 to an extended position P4. As a result, positioning of a workpiece in recess 98 can be altered depending on the position of stops 106. Another pair of stops 108, are resiliently mounted in plate 90 so as to yield toward an angled surface 110 in response to positioning of a workpiece in recess 98. Thus, plate 90 including recess 98 provides an adapter for receiving a workpiece which otherwise will not fit in recess 48 of fixture plate 16. However, use of plate 90 in connection with fixture plate 16, transfers the benefits of fixture plate 16, e.g. inclined position and rotation, to a workpiece being mounted in recess 98 of plate 90.

Figure 8:
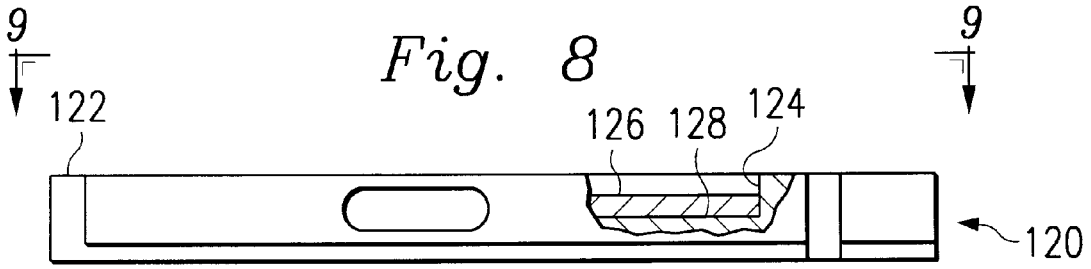
FIG. 8 is a side view illustrating an embodiment of a second adapter plate for mounting on the workpiece holder.
Figure 9:
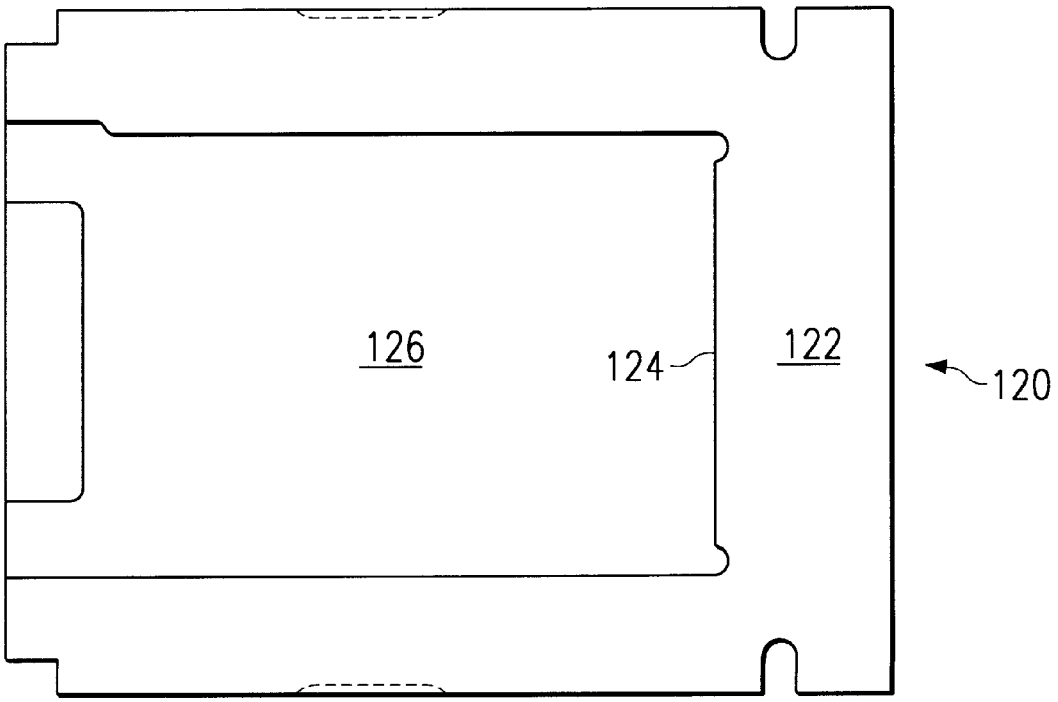
FIG. 9 is a top view illustrating an embodiment of the second adapter plate as viewed along the line 9—9 of FIG. 8.

Another adapter plate 120, FIGS. 8 and 9, may be used in connection with fixture plate 16, to accommodate a workpiece which will not fit in recess 48 of fixture plate 16, FIG. 2, or will not fit in recess 98 of adapter plate 90, FIG. 7. Plate

120, FIGS. 8 and 9, is preferably formed of a machinable molded plastic material of the UHMW type mentioned above. Plate 120 inserts into recess 48 of fixture plate 16 so that plate 120 is supported on workpiece holder 10 and can therefore be inclined and rotated with fixture plate 16 as discussed above.

Plate 120 includes a surface 122 having a recess 124 formed therein. Also plate 120 includes a resilient pad 126 mounted on a support surface 128 of recess 124. Pad 126 is preferably formed of the anti-static material discussed above regarding strips 70*a*, 70*b*, 70*c* and 100*a*, 100*b* and 100*c*. Plate 120 does not include tool access grooves and stops discussed above and is for top-down attachment of a mounting bracket to a workpiece such as a hard drive for a computer. Use of plate 120 in connection with fixture plate 16 transfers the benefits of fixture plate 16, e.g. inclined position and rotation, to a workpiece being mounted in recess 124 of plate 120.

As a result, one embodiment provides a workpiece holder including a base and a support plate pivotally mounted for inclined adjustment on the base. A fixture is rotatably mounted on the support plate.

Another embodiment provides an adjustable fixture including a base and a support plate adjustably mounted on the base for movement to a plurality of inclined positions. At least one support arm interconnects the base and the support plate for securing the support plate in an inclined position. A fixture plate is rotatably mounted on the support plate.

Another embodiment provides a universal fixture including a base and a support plate adjustably mounted on the base for movement to a plurality of inclined positions. At least one support arm interconnects the base and the support plate for securing the support plate in an inclined position. A fixture plate is rotatably mounted on the support plate, and a plurality of positioning stops and an adjustable slide are mounted on the fixture plate.

A further embodiment provides a method of performing assembly operations on a workpiece by adjusting a support plate to an inclined position relative to a base member, securing a support arm to maintain the support plate in the inclined position, placing the workpiece on a fixture plate rotatably connected to the support plate, and rotating the fixture plate to various positions relative to the support plate for performing work on the workpiece.

As it can be seen, the principal advantages of these embodiments are that the workpiece component is located in the fixture and is automatically aligned for accurate location and attachment of the mounting side rails with the proper height and setback so that the component is installed in correct orientation with the computer chassis, bezels and cover plates. In addition, inclined height adjustment of the support plate, and rotation of the fixture on the support plate, provide an ergonomic advantage to the assembler performing the pre-assembly operations. Additional fixtures can be mounted on the inclined and rotatable fixture so that various workpiece components may be serviced by the assembler on the fixture.

Although illustrative embodiments have been shown and described, a wide range of modification, change and substitution is contemplated in the foregoing disclosure and in some instances, some features of the embodiments may be employed without the corresponding use of other features. Accordingly, it is appropriate that the appended claims be construed broadly and in a manner consistent with the scope of the embodiments disclosed herein.

What is claimed is:

1. A work piece holder comprising:

a base;

a support plate pivotally mounted for inclined adjustment on the base; and a fixture rotatably mounted on the support plate, the fixture including a recess formed therein for receiving a workpiece and having a plurality of stops mounted therein and extending into the recess.

2. The workpiece holder as defined in claim 1 wherein the support plate is supported in an inclined position by at least one support arm.

3. The workpiece holder as defined in claim 2 wherein the support arm includes a first end pivotally connected to the base and a second end slidably connected to the support plate.

4. The workpiece holder as defined in claim 3 where in the support plate includes a groove formed therein for receiving the second end of the support arm.

5. The workpiece holder as defined in claim 4 further comprising means for securing the second end of the support arm in a stationary position in the groove for maintaining the support plate in the inclined position.

6. The workpiece holder as defined in claim 1 wherein the recess includes an adjustable slide movably mounted therein.

7. The workpiece holder as defined in claim 6 wherein the adjustable slide includes an extension resiliently mounted thereon.

8. The workpiece holder as defined in claim 1 wherein the fixture includes a plurality of tool access grooves formed therein adjacent the recess.

9. The workpiece holder as defined in claim 1 wherein the recess includes a support surface including a resilient pad mounted thereon.

10. The workpiece holder as defined in claim 1 further comprising a first adapter plate for mounting in the recess of the fixture.

11. The workpiece holder as defined in claim 10 wherein the first adapter plate includes a recess formed therein for receiving another workpiece.

12. The workpiece holder as defined in claim 11 wherein the recess in the first adapter plate includes a support surface including a resilient pad mounted thereon.

13. The workpiece holder as defined in claim 11 wherein the first adapter plate includes a plurality of tool access grooves formed therein.

14. The workpiece holder as defined in claim 11 wherein the first adapter plate includes a plurality of stops mounted thereon.

15. The workpiece holder as defined in claim 11 further comprising a second adapter plate for mounting in the recess of the workpiece.

16. The workpiece holder as defined in claim 15 wherein the second adapter plate includes a recess formed therein for receiving a further fixture.

17. The workpiece holder as defined in claim 16 wherein the recess formed in the second adapter plate includes a support surface including a resilient pad mounted thereon.

18. An adjustable fixture comprising:

a base;

a support plate adjustably mounted on the base for movement to a plurality of inclined positions;

at least one support arm interconnecting the base and the support plate for securing the support plate in an inclined position; and a fixture plate rotatably mounted on the support plate, the fixture plate being formed of an ultra-high molecular weight anti-static plastic material and being reinforced with an anti-warp backing plate.

19. The adjustable fixture as defined in claim 18 wherein the fixture plate includes adjustable stops mounted thereon.

20. The adjustable fixture as defined in claim 18 wherein the fixture plate includes resilient stops mounted thereon.

21. The adjustable fixture as defined in claim 18 wherein the fixture plate includes a recess formed therein for receiving a workpiece, and a resilient pad mounted in the recess.

22. The adjustable fixture as defined in claim 21 wherein the resilient pad is formed of anti-static material.

23. A universal fixture comprising:

a base;

a support plate adjustably mounted on the base for movement to a plurality of inclined positions;

at least one support arm interconnecting the base and the support plate for securing the support plate in an inclined position;

a fixture plate rotatably mounted on the support plate; and a plurality of positioning stops and an adjustable slide mounted on the fixture plate.

* * * * *